United States Patent [19]

Kultaranta Tapani

[11] Patent Number: 4,597,326

[45] Date of Patent: Jul. 1, 1986

[54] ROLLER PRESS

[75] Inventor: Tapani Kultaranta, Järvenpää, Finland

[73] Assignee: Oy Wärtsilä Ab, Helsinki, Finland

[21] Appl. No.: 648,760

[22] Filed: Sep. 7, 1984

[30] Foreign Application Priority Data

Sep. 16, 1983 [FI] Finland ..... 833307

[51] Int. Cl.[4] ..... B30B 15/14; B30B 15/16

[52] U.S. Cl. ..... 100/50; 100/162 B; 100/170; 100/47; 29/116 AD; 72/243

[58] Field of Search ..... 100/47, 48, 50, 161, 100/162 R, 162 B, 168, 170; 29/113 R, 113 AD, 116 R, 116 AD; 72/241, 243, 245, 8, 20

[56] References Cited

U.S. PATENT DOCUMENTS

| | | | |
|---|---|---|---|
| 4,023,480 | 5/1977 | Biondetti | 100/47 |
| 4,154,160 | 5/1979 | Kusters | 100/170 X |
| 4,222,255 | 9/1980 | Lehmann | 72/243 X |
| 4,472,958 | 9/1984 | Biondetti | 29/116 AD X |
| 4,480,452 | 11/1984 | Schnyder | 100/170 X |
| 4,481,799 | 11/1984 | Glattfelder et al. | 100/162 B X |

*Primary Examiner*—Peter Feldman

*Attorney, Agent, or Firm*—Dellett, Smith-Hill and Bedell

[57] ABSTRACT

Regulating means in a roller press comprising a number of rolls for the adjustment of a press load and a deflection in deflection compensated rolls, especially in a calander stack provided for the glazing of a continuous thin running web like a paper web. The outer-most rolls in said roller press comprise means for the deflection compensation and one or several different press rolls, which are located between these outer-most rolls. Said roller press is provided with a feed-back connection arranged between a control circuit of the press load and a deflection compensation circuit of the deflection compensated rolls, which feed-back maintains a ratio between the press load and the hydraulic pressure in a roll of said compensable rolls. Said feed-back is further arranged in accordance to an alteration of a set point of the press load to control said press load, whereby said feed-back slows down a change speed in the press load so, that said change is carried out in suitable relation to the control speed of the deflection compensated rolls.

10 Claims, 1 Drawing Figure

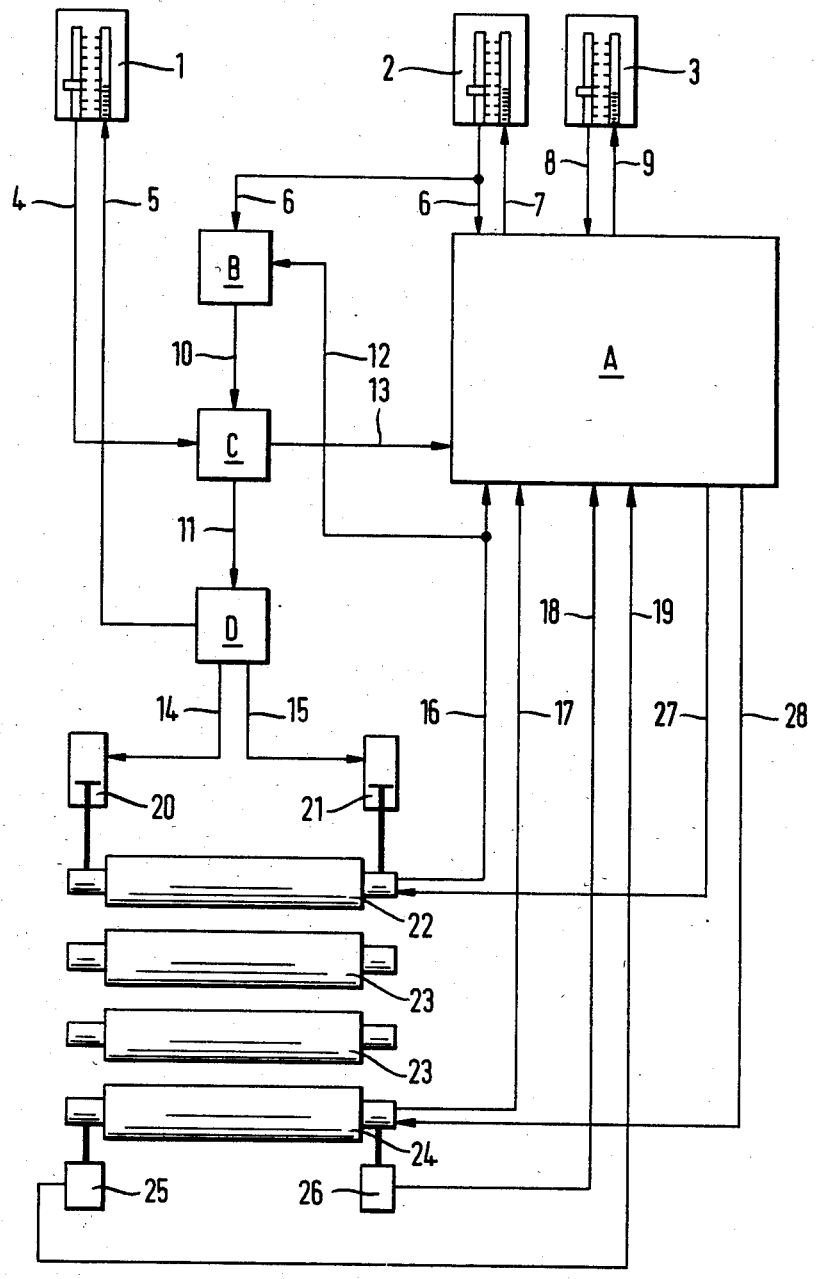
1
2
3
4
5
6
6
7
8
9
B
A
10
12
13
C
11
D
18
19
14
15
16
17
27
28
20
21
22
23
23
24
25
26

ROLLER PRESS

BACKGROUND OF INVENTION

The invention relates to regulating means in a roller press according to the preamble of claim 1 for the regulation of the line pressure between adjacent rolls in a multiple roll press. The means are primarily meant in connection with the glazing of a continuous web, especially a paper web. A press constructed for this purpose comprises several different rolls located stacked in a vertical plane, of which the upper-most one and the lower-most one are so-called deflection-compensated rolls. In order to increase the line pressure generated by the gravity force of the roll, one applies power means at the ends of the upper-most roll, usually hydraulic cylinders by which the press load is adjusted. Hydraulic adjustment circuits for the deflection compensation and the load adjustment of the upper-most roll and the lower-most roll have been separate and their functions have not been previously synchronized with each other.

OBJECT AND SUMMARY OF INVENTION

The object of this invention is to eliminate the disadvantages that arise from lack of synchronization of the functions of the adjustment circuits. The characteristics of the invention are given in claim 1. The object of the invention is possible to reach by regulating means constructed in this manner, since the change in the press load is decreased to be in relation to the adjustment speed attainable in the deflection-compensated rolls.

A continuous web is glazed in a roller press comprising several rolls stacked in a common, usually vertical plane so that the web is threaded from above downwards through nips between the rolls. The nip pressure increases when moving downwards from one nip to another due to the cumulated mass of the rolls. Power members are located at the ends of the upper-most roll in order to increase the line pressure above that pressure generated by the gravity, usually hydraulic cylinders for the generation and the adjustment of the load.

Since the rolls are supported at both ends of their shafts, the outer-most rolls of the roll stack are deflected as a result of the load. In order to maintain the roll outer surface straight and the line pressure even, so-called deflection-compensated rolls are applied as the outermost rolls. Several constructionally different models of these deflection-compensated rolls exist. Common to them is, however, a line pressure dependent deflection correction, which is carried out by adjusting the pressure of a hydraulic system, which is located between the fixed roll shaft and the rotating mantel. This pressure acts on the mantle either directly or indirectly via movable members, thus maintaining the mantle straight and transmitting the load to the shaft which is elastically deflected. It is usually not possible to measure the deflection of the mantle and the shaft during the operation of the roller press, but each deflection compensated roll is provided by predetermined, line pressure dependent characteristic adjustment values.

The rolls are either mutually connected or disconnected from each other, when starting and stopping the roller press and in connection with a paper rupture, by means of a vertical motion of the lower-most roll. The object of the disconnection is to protect the soft-surfaced fiber rolls of the roll stack in case of a web rupture. A situation often comes forward during the operation of the roller press, whereby the load connected with the upper-most roll changes. Especially the mantle of the upper-most deflection-compensated roll is deflected in connection with these changes, because the hydraulic circuit for the deflection compensation and the hydraulic circuit for the load adjustment operate at different speeds. The operations of the circuits are interconnected in present constructions, so that when changing the load the message or signal of an alteration is directed to the circuit for the deflection-compensation in order to provide a corresponding alteration. The circuit for the deflection compensation is, however, slower by its function in comparison to the load adjustment circuit, which is constructionally less complicate, and the line pressure of the nip is subjected to short-timed pressure differences and especially soft rolls to depressions and to changes in the diameter, as a result of which the rolls must be replaced for a repair.

The hydraulic cylinders generating the press load are usually interconnected and they are influenced by the same hydraulic pressure. According to the invention, the effect of the load adjustment method can be further improved by connecting a separate control circuit to both press load generating cylinders and by applying at the ends of the upper-most and the lower-most roll mass measuring elements according to the German Patent Application No. 3007452 and by arranging the adjustment of the line pressures in the upper-most and the lower-most nips by a processor circuit to correspond a desired gloss result for the paper.

BEST MODE OF INVENTION

The invention is described in detail in the following with reference to the attached drawing, the only FIGURE of which shows schematically the construcion of control means according to the invention. The roller press and its control system is schematically shown in the drawing, within that accuracy which is necessary in connection with this invention. The roll stack is only briefly sketched, whereby rolls are separated. The parts of the means are marked by items 20–26. Electronic processor circuits are marked by letters A,B and C and the electro-hydraulic control circuit by a letter D. The setting and displaying devices of the load and the compensation of the upper and the lower roll are correspondingly marked by items, 1,2 and 3. As a favourable construction of these, a set point and display pair device provided with a linear scale is shown, the left-side set point member of which is constituted by a potentiometer provided with a scale, by which the set point is adjusted. Set point signal connections are marked by items 4,6 and 8. The right-side scale and display column is constituted by a light column indicating the present measured value. Items 5,7 and 9 show present value signal connections. The connections between the press, control circuits and the set point and display pair device are marked by items 4–19 and 27–28. Items 27 and 28 indicate connections of the processor circuit A to deflection compensated rolls 22 and 24 for the deflection guidance by a method commonly known. The hydraulic circuits of these rolls are not shown, since they can be usual ones.

The set point and display pair 1 is used for adjusting the desired value (the set point) of the press load and for displaying by way of the light column the present value of the press load.

The connection shown in the FIGURE, and the division of the processor cirucits in to blocks, is not the only solution for the realization of the method according to the invention. Said division is carried out in agreement with the FIGURE for the purpose of a most clear disclosure of the function of the control means.

The function of the control means is described in the following by observing what will happen, when the set point of the press load is altered and the signals from the potentiometer, which is in the set and display pair 1, is transmitted via connection 4 to programmable processor circuit C. The signal is transmitted therefrom via connection 13 to circuit A, which gives new control values to the deflection compensated rolls 22,24 via connections 27 and 28. The signal indicating the state of the deflection of the compensated rolls is received by circuit A via connections 16 and 17 and especially the deflection of the upper roll by circuit B via connection 12. Circuit C receives via connection 10 a signal indicating the state of the upper roll from circuit B, in which a possible offset from the balanced state of the compensation is further taken into account through the connection 6. Thus, set point and display pair 2 is used for adjusting the amount by which it is desired that the deflection-compensation force applied to the roll 22 should differ from the deflection-compensation force calculated on the basis of the line pressure, and for indicating the amount by which the deflection-compensation force actually applied to the roll 22 differs from the calculated deflection-compensation force. Similarly, the set point and display pair 3 is used for adjusting and displaying the difference between the deflection-compensation force applied to the roll 24 and the nominal deflection-compensation force calculated on the basis of the line pressure. The deflection-compensation forces applied to the rolls 22 and 24 may differ by up to 15% from the nominal deflection-compensation forces.

The control signal for the adjustment of the press load passes through connection 11 to the electro-hydraulic circuit D and is altered in accordance to that allowed by the signal given by the feed-back connection 12. Circuit D includes, besides the electrical control, a servohydraulic valve and other necessary members for the control of cylinders 20 and 21. The feed-back delays the change in the press load, so that press load changes at a speed that is suitably related to the control speed of the deflection compensation mechanisms.

For the control of the press load, the line pressure of the lower roll may be measured by load measurement elements located in hydraulic cylinders 25 and 26, as described in the German Patent Application 3007452. The signal from the elements comes through connections 18 and 19 to circuit A.

Processor circuits A,B,C and D are programmable and, by program or its parameter alterations, the roll replacement, a change in the diameter of the rolls etc. are taken into account.

The invention is not limited to the embodiment shown, but several modifications thereof are feasible within the attached claims.

I claim:

1. A roller press comprising first and second outer, deflection-compensated rolls and at least one inner roll disposed between the outer rolls whereby a plurality of nips are established between the rolls, each of the outer rolls having a mantle portion that has two ends and engages an inner roll, and a shaft portion that extends axially of the mantle portion and has end sections that project axially beyond the two ends of the mantle portion, and the roller press also comprising load means for applying a press load to the outer rolls by way of the end sections of the shaft portions, press load control means for controlling the magnitude of the press load applied by the load means, first and second mechanisms associated with the first and second outer rolls respectively for applying forces to those rolls to compensate for deflection thereof, said first and second mechanisms providing signals that are representative of the deflection-compensation forces applied to the first and second outer rolls respectively, and regulating means connected to receive said signals and also connected to said press load control means for maintaining predetermined respective relationships between the deflection-compensation forces applied to said outer rolls and the magnitude of the press load applied to the outer rolls.

2. A roller press according to claim 1, wherein said first and second mechanisms are hydraulically actuated and said signals are representative of the hydraulic pressure applied to said mechanisms.

3. A roller press according to claim 1, wherein said press load control means are connected to control the press load applied to only one of said outer rolls.

4. A roller press according to claim 1, wherein said load means comprise stationary abutment means engaging one of said outer rolls and movable drive means engaging the other of said outer rolls.

5. A roller press according to claim 1, wherein the rolls are disposed in a vertical stack with the first and second outer rolls at the top and bottom of the stack respectively.

6. A roller press according to claim 1, comprising deflection control means for controlling the magnitude of the deflection-compensation forces applied to the first and second outer rolls to compensate for deflection thereof, and adjustable set point means connected to the press load control means for selectively adjusting the magnitude of the press load, the press load control means being connected to the deflection control means for controlling the magnitude of the deflection-compensation forces in response to adjustment of the set point means.

7. A roller press according to claim 1, comprising means for calculating the magnitude of a nominal deflection-compensation force on the basis of the magnitude of the press load, and auxiliary control means for adjusting the magnitude of the deflection-compensation force applied to at least the first outer roll independently of the magnitude of the press load, whereby the magnitude of the deflection-compensation force actually applied to the first outer roll can be made to deviate from the nominal deflection-compensation force.

8. A roller press according to claim 7, wherein the auxiliary means can adjust the actual deflection-compensation force to within ±15% of the nominal deflection-compensation force.

9. A roller press according to claim 1, comprising deflection control means for controlling the magnitude of the deflection-compensation force applied to at least the first outer roller, and wherein the regulating means comprise a programmable processor unit which is connected to the press load control means and to the deflection control means.

10. A roller press according to the claim 1, wherein the regulating means have an input for receiving a signal indicating the desired magnitude of the press load applied to the outer rolls and repsond to a change in the signal indicating the desired magnitude of the press load by generating a changed press load signal that is applied to the press load control means and changed deflection-compensation signals that are applied to said first and second mechanisms, and said press load control means respond to a changed press load signal more rapidly than the first and second mechanisms respond to changed deflection-compensation signals, and wherein the regulating means comprise means for delaying generation of a changed press load control signal relative to generation of changed deflection-compensation signals.

* * * * *